US005570888A

United States Patent [19]

Robinson et al.

[11] Patent Number: 5,570,888

[45] Date of Patent: Nov. 5, 1996

[54] THUMP FOOTBALL GAME AND APPARATUS

[76] Inventors: Calvin L. Robinson, 103 Bennett Lake Rd., Monroe, La. 71203; Dewayne Robinson, 1789 Hermon Johnson Rd., Monroe, La. 71202

[21] Appl. No.: 510,825

[22] Filed: Aug. 3, 1995

[51] Int. Cl.[6] ..... A63F 3/00; A63F 7/06

[52] U.S. Cl. ..... 273/317.5; 273/128 R; 273/108.4; 273/277

[58] Field of Search ..... 273/94, 85 R, 273/108, 113, 114, 115, 116, 117, 118 R, 123 R, 126 R

[56] References Cited

U.S. PATENT DOCUMENTS

| | | | |
|---|---|---|---|
| 718,709 | 1/1903 | Grandchamp | 273/126 R |
| 1,145,955 | 7/1915 | Wittstein | 273/94 |
| 1,357,778 | 11/1920 | Jacobs | 273/126 R |
| 1,603,717 | 10/1926 | Rubino | 273/94 |
| 1,615,491 | 1/1927 | Thornton | 273/94 |
| 1,641,525 | 9/1927 | Boesson | 273/85 R |
| 1,663,404 | 3/1928 | Hands | 273/94 |
| 2,140,193 | 12/1938 | Weinberger | 273/94 R |
| 2,946,590 | 7/1960 | Bruner | 273/118 R |
| 4,550,911 | 11/1985 | Daley | 273/94 |
| 4,555,114 | 11/1985 | Dozier | 273/128 R |
| 4,733,867 | 3/1988 | Kemp | 273/85 R |
| 4,762,323 | 8/1988 | Blagg | 273/126 R |
| 4,765,622 | 8/1988 | Rienzo | 273/85 R |
| 4,872,679 | 10/1989 | Bohaski et al. | 273/85 R |
| 5,110,127 | 5/1992 | Potter | 273/85 R |
| 5,186,461 | 2/1993 | Tucker | 273/94 |
| 5,257,783 | 11/1993 | Callaghan | 273/94 |
| 5,451,050 | 9/1995 | Charles | 273/94 |

*Primary Examiner*—Sebastiano Passaniti
*Attorney, Agent, or Firm*—David L. Ray

[57] ABSTRACT

A football game and football game apparatus in which a simulated football is thumped by the finger of a player to place the football in play and move the football to various locations on a board provided with the game. The football apparatus includes a game board has a planar playing surface, yard lines and goal lines marked thereon, movable goal posts, and a trough adjacent to the goal lines to catch the simulated football. The game board may be supported by legs, or placed on the top of a table.

3 Claims, 4 Drawing Sheets

THUMP FOOTBALL GAME AND APPARATUS

BACKGROUND OF THE INVENTION

1. Field of the Invention

The present invention relates to table top games. More particularly, the present invention relates to table top football games. Even more particularly, the present invention relates to tabletop football games in which a simulated football is thumped by the finger of a player on a tabletop simulated football field.

2. Description of the Related Art

Table top games are known in the art. Exemplary of the games of the related art are those disclosed in the following U.S. Pat. No. : 5,186,461; 5,110,127; 4,872,679; 4,765,622; 4,733,867; 4,555,114; and 4,550,911.

SUMMARY OF THE INVENTION

In accordance with the present invention there is provided a football game and football game apparatus in which a simulated football is thumped by the finger of a player to place the football in play and move the football to various locations on a board provided with the game. The game board has a planar playing surface, yard lines and goal lines marked thereon, movable goal posts, and a trough adjacent to the goal lines to catch the simulated football.

DESCRIPTION OF THE PREFERRED EMBODIMENTS

Figure 7:
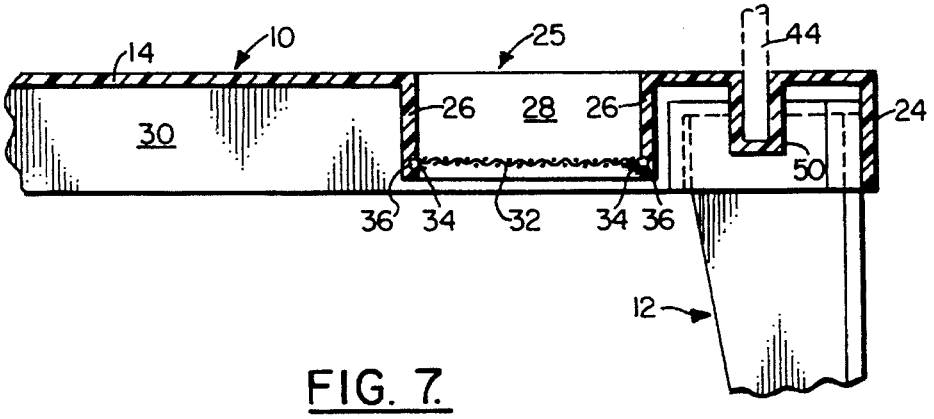
FIG. 7 is a cross-sectional view taken along lines 7—7 of FIG. 1.

Referring now to the drawings, the game board Game of the present invention is generally indicated by the numeral 10. Game board 10 may supported by four legs, one of which is shown in FIG. 7 and is generally indicated by the numeral 12. Each of four legs 12 is located at each of the four corners of game board 10. Legs 12 may be connected to game board 10 and may be of any desired shaped. A conventional screw caster generally indicated by the numeral 12*a* may be connected to the bottom of each led 12 to level game board 10 if desired. If desired, the legs 12 may be omitted, and game board 10 may be placed on top of a table.

Game board 10 has a top, flat, rectangular planar playing surface 14 with indicia printed or engraved thereon corresponding to a conventional football field used in the version of football common in the United States of America. While the game board of the present invention is not limited to specific sizes, a practical size for the game board is four feet wide by eight feet long, or three feet wide by six feet long.

The two parallel longer sides of the rectangular game board 10 have a plurality of circled numbers adjacent to two parallel side lines 15—15 ranging in increments of five from the number "5" to the number "50" to indicate the distance in "yards" from the goal lines 16—16. Each pair of identically numbered circled numbers on each side of the game board are connected by a straight yard line 18, each yard line 18 being equal in length. For example, the two circled numbers "50" are connected by line 18 to indicate the center yard line of the football field. A plurality of hash marks 20 and 22 are located on each yard line 18 equidistantly from the closest sideline 15 at an approximate distance from the closest sideline 15 of one-fourth of the total length of the yard line 18.

Two identical rectangular troughs 25—25 shown in FIGS. 1, 6, 7 and 10 are each located parallel to the two parallel shorter ends 24—24 labeled "END ZONE" on game board 10 and adjacent to goal lines 16—16. Each trough 25 has two identical parallel walls 26—26 which are parallel to the shorter ends 24—24 of game board 10, and two identical parallel walls 28—28 which connect walls 26—26 together at each end thereof and are parallel to the sides 30—30 of game board 10.

Located in the bottom of each trough 25 is a net 32. Net 32 is connected to walls 26—26 by two rods 34—34 shown in FIGS. 6 and 7 which are force fitted in a groove 36 located on the inside of each wall 26. If desired, net 32 could be attached to trough 25 by any other conventional method known to those skilled in the art.

Figure 1:
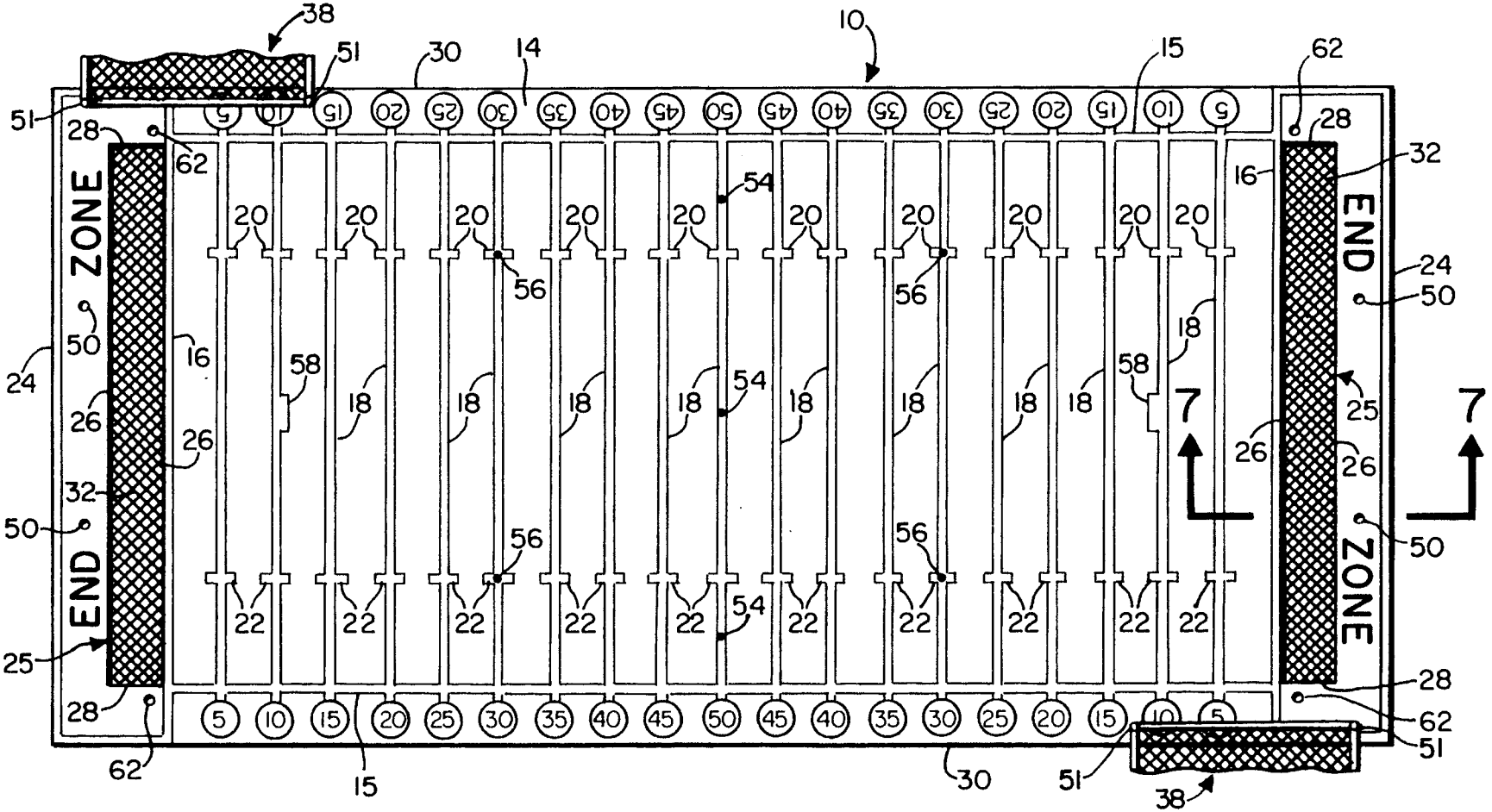
FIG. 1 is a top plan view of the game board of the invention.
Figure 8:
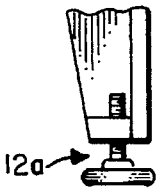
FIG. 8 is an elevational view, partly cut-away, of a goal post of the invention.
Figure 8:
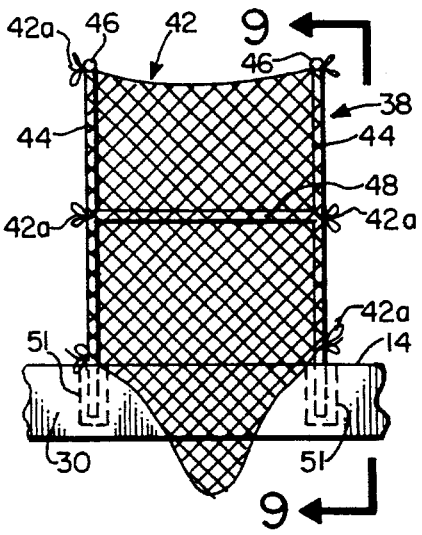
Figure 9:
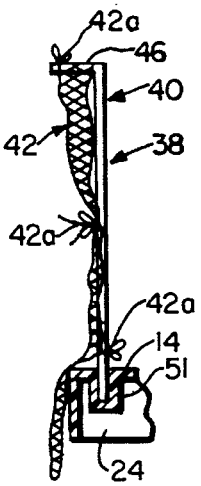
FIG. 9 is a cross-sectional view, partly cut-away, taken along lines 9—9 of FIG. 8.
Figure 10:
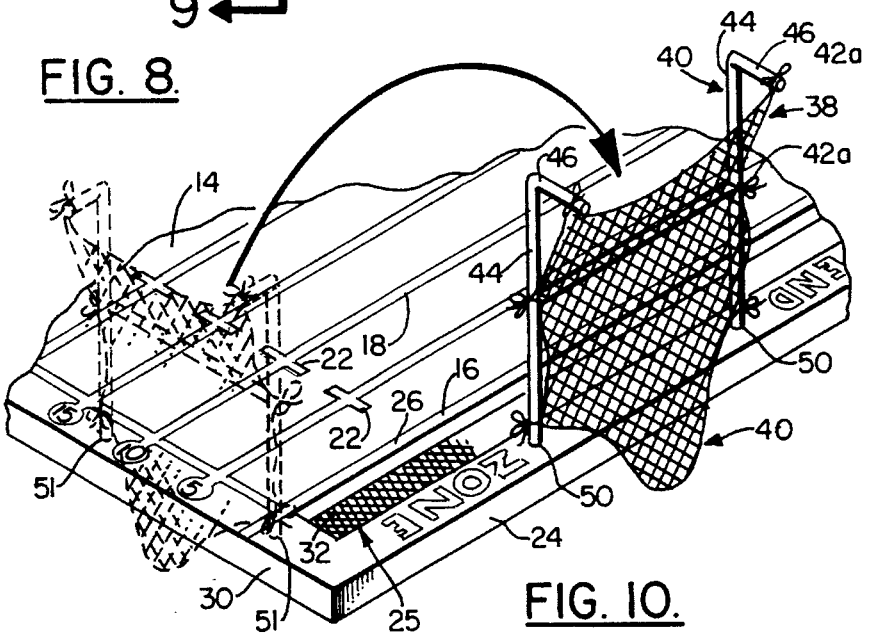
FIG. 10 is a perspective view, partly cut-away, of one end of the game board of the invention.

Two identical goal post assemblies generally indicated by the numeral 38 are shown attached to game board 10 in FIG. 1 and in greater detail in FIGS. 8–10. The goal post assembly includes an "H" shaped goal post generally indicated by the numeral 40 and a net generally indicated by the numeral 42 connected thereto by strings 42*a*. Goal post 40 has two vertical, parallel legs 44 each having an upper portion 46 connected parallel to each other and perpendicularly to leg 44. Legs 44—44 are connected together by cross-bar 48 which is perpendicular to legs 44—44.

Game board 10 has two pairs of identical hollow cylinders 50 located in the "END ZONE" area of game board 10 for receiving the lower portion of legs 44—44 of goal post assembly 38 to selectively connect goal post assembly to the "END ZONE" area of game board 10. Game board 10 has two additional pairs of identical hollow cylinders 51 located adjacent to sides 30—30 of game board 10 to receive the lower portion of legs 44—44 of goal post assembly 38 when the goal post assembly 38 is not needed in the "END ZONE" area of game board 10.

Figure 3A:
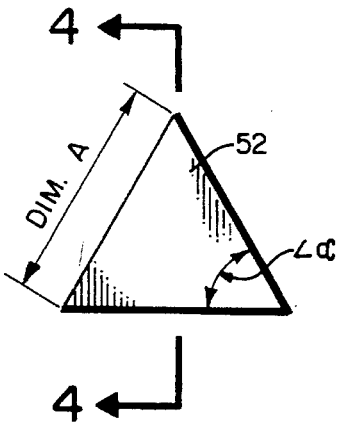
FIG. 3A is an elevational view of a first simulated football of the invention.
Figure 3B:
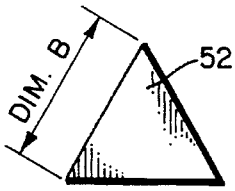
FIG. 3B is an elevational view of a second simulated football of the invention.
Figure 3C:
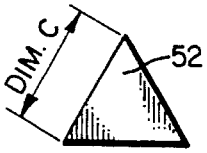
FIG. 3C is an elevational view of a third simulated football of the invention.
Figure 4A:
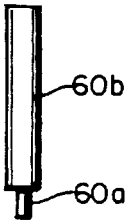
FIG. 4A is an elevational view of a flag.
Figure 4:
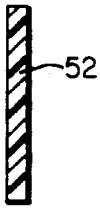
FIG. 4 is a cross-sectional view taken along lines 4—4 of FIG. 3A.

A rigid, triangular "football" 52 is used to simulate a football. In FIGS. 3A–3C, three different sizes of football 52 are shown. In FIG. 4, the ball 52 can be seen to be rectangular in cross-section. Only one size is used in a game, but the smaller football is used to make the game more difficult for skilled players. Preferably, DIM. A is one and one half inches, DIM. B is one inch, and DIM. C is three-quarter inch. Any desired size football 52 can be used, but the smaller balls 52 require greater skill on the part of the player.

THE PLAYING AND SCORING RULES ARE AS FOLLOWS

BEGINNING GAME

1. Two or more players can play the game.

2. Players toss coin to see which player gets first ball.

3. Player who wins toss can select ball or direction of play.

Figure 2:
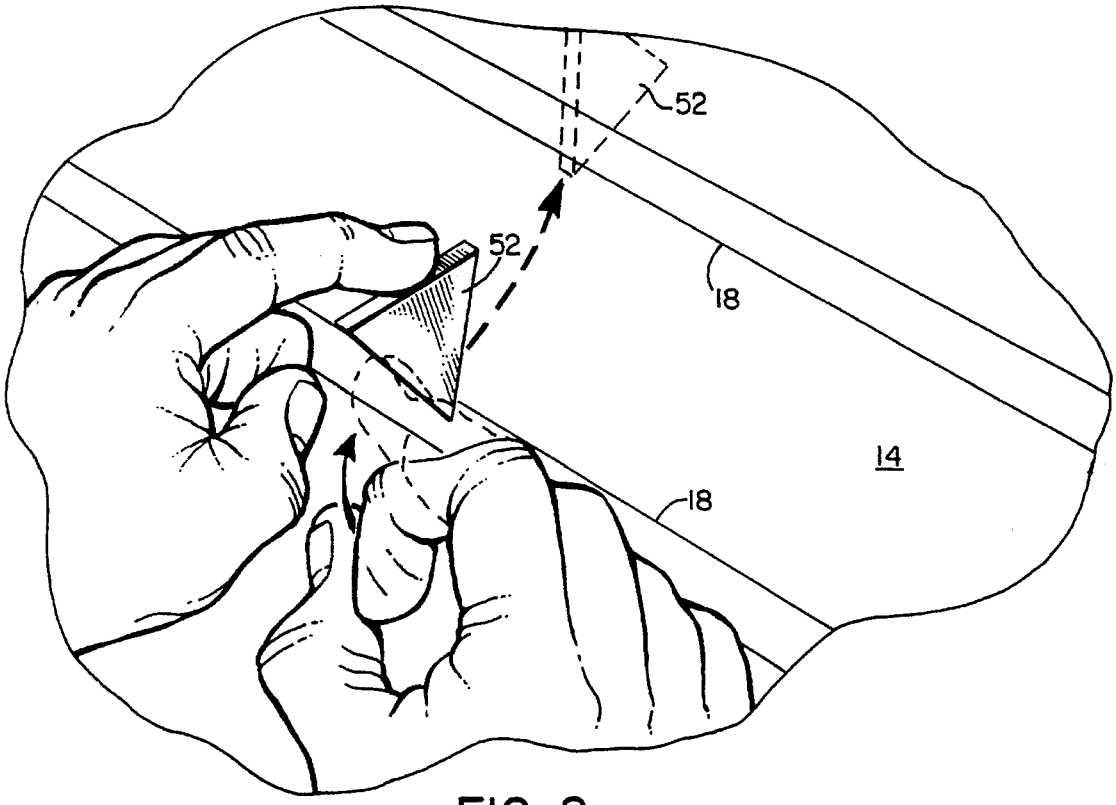
FIG. 2 is a perspective view, partly cut-away, of a player using a finger to thump a simulated football on said game board of the invention to attempt to score points in the game.

4. One player will thump off from the twenty five (25) yard line to opponent. When thumping off, the ball must be in an upright position on one of the three (3) pointed ends as shown in FIG. 2. NOTE: PLAYER MUST HAVE FINGERS IN THUMPING POSITION BEFORE THUMPING BALL.

Figure 5:
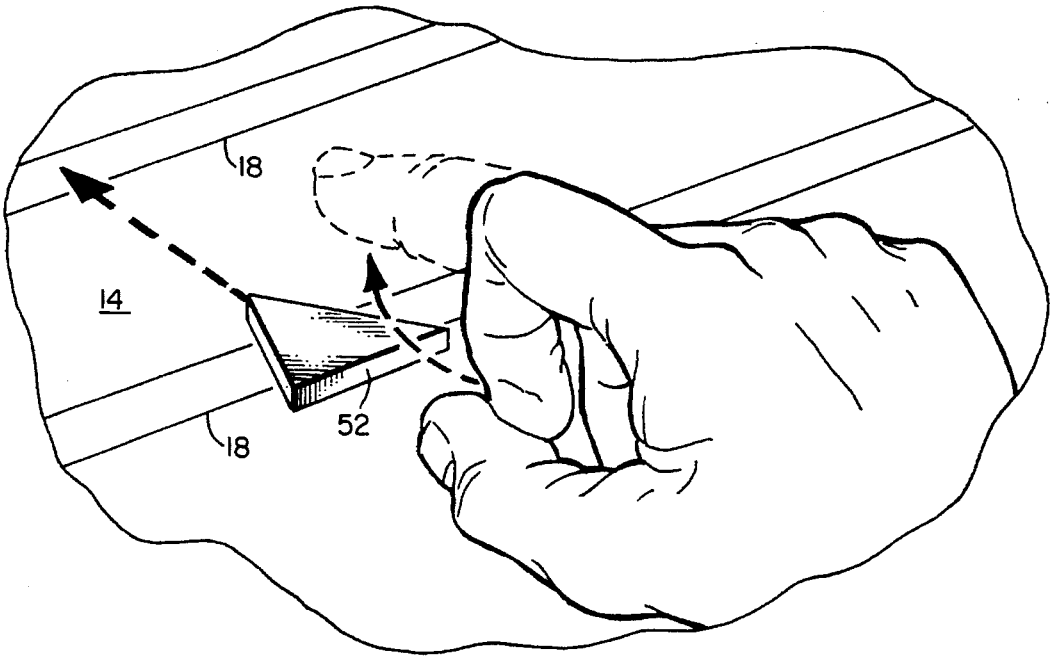
FIG. 5 is a perspective view, partly cut-away, of a player using a finger to thump a simulated football on said game board of the invention to attempt to score points in the game.

4. Opponent must start play where ball stops unless thumped into end zone area, out of bounds, or off board. If so, opponent starts play at the twenty (20) yard line. Ball 52 must be placed flat as shown in FIG. 5 with one of the three (3) pointed ends touching the twenty (20) yard line in center of field.

TOUCHDOWNS AND PUNTS

Figure 6:
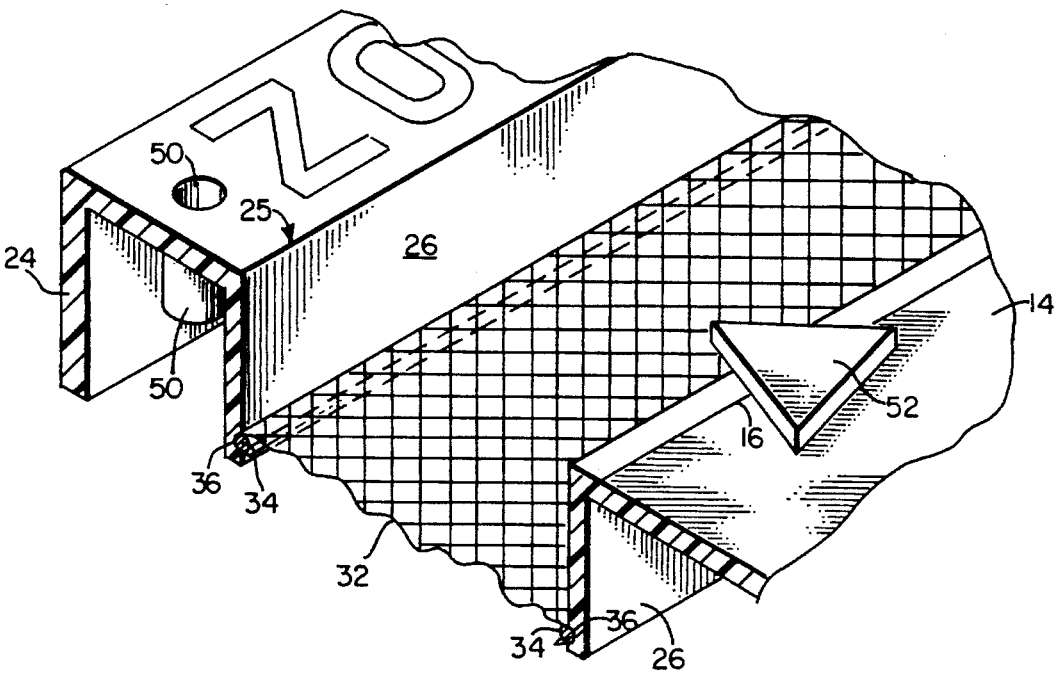
FIG. 6 is a perspective view, partly cut-away, of a simulated football lying on the game board of the invention.

5. In order for a player to score a touchdown, player must try to thump any part of the ball over the edge of the end zone toward his opponent as shown in FIG. 6. The ball 52 cannot fall into the net 32 in trough 25. The player has four (4) thumps to accomplish this task. A touchdown counts six (6) points.

6. If a player thumps ball 52 into net 32 or does not score on fourth (4th) thump, it is considered a punt unless inside the twenty five (25) yard line. If player thumps ball 52 into net 32 inside the (25) yard line, this will be considered a fumble. If player thumps ball 52 on fourth thump, and does not score and ball does not fall into net, the player tried to score on fourth down and missed. If so, ball changes possession and opponent starts play where ball stopped.

PENALTIES

7. Loss of Down: Results when player thumps ball out of bounds while trying to score a touchdown. If so, the ball comes back to where it was kicked, plus loss of down.

8. Gain of Down: Results when player thumping off to opponent thumps ball 52 out of bounds, off board, or into net. This gives the opponent an extra down, five (5) instead of four (4.)

ON SIDE THUMP

9. If a player scores and opponent can win game with a score on next possession, player may then and only then attempt an on side thump. To accomplish this task, player must thump ball 52 from twenty (20) yard line and try to land any part of the ball onto the thirty five (35) yard line. If so, he gets possession and four (4) more thumps to score. When attempting an on side thump, the ball 52 must be in an upright position on one of three (3) pointed ends as shown in FIG. 2.

FIRST DOWNS

10. Player can get one first down each possession of play. Player accomplishes this task by covering one of the three (3) dots 54 located on the fifty (50) yard line with ball 52. If so, player gets four (4) more thumps to score. A player cannot get a first down after passing dots 54 on the fifty (50) yard line. Player cannot get a first down if he is penalized.

REFEREES

11. Referees may be elected to call game penalties, turnovers, etc. Referees' calls must be obeyed. Any necessary ball movement must be done by the referees or the referees must be consulted before ball movement. If not, player gets a technical foul. Referees pick which player will call coin toss. NOTE: PLAYERS HAVE ONE (1) THIRTY (30) SECOND TIME OUT PER GAME TO USE TO THEIR ADVANTAGE.

TECHNICAL FOULS

12. Arguing with refs or touching ball without referee's consent. Penalties at referee's discretion; whatever referee decides. Penalties given should be reasonable, such as loss of down, loss of yardage, etc. NOTE: IF BALL IS THUMPED, HITS BACK SIDE OF END ZONE, AND BOUNCES BACK ONTO TABLE, THE BALL IS CONSIDERED OFF THE BOARD.

TURNOVERS

13. Interception: Results when player thumps ball into net or off table from thirty (30) or more yards out while trying to score and player has thumps left. Opponent gets ball at twenty (20) yard line.

14. Fumble: Results when a player thumps ball into net or off table from twenty five (25) or less yards out while trying to score. Opponent gets ball where ball was thumped.

FIELD GOALS AND EXTRA POINTS

15. A player may attempt a field goal whether he scores or not. If player scores, he must place ball on hash mark 56 thirty (30) yards out and thump ball between poles over cross bar to get point(s). It doesn't matter how high ball is kicked. A player gets one (1) point for a field goal after a touch down with one exception. EXCEPTION: If a player thumps the ball once in his possession and scores, a field goal made afterwards counts three (3) points. Player may choose which hash mark on thirty (30) yard line he wants to attempt field goal from. NOTE: IF A PLAYER THUMPS THE BALL ONCE IN HIS POSSESSION AFTER A "THUMPOFF" AND THE BALL FALLS INTO THE NET, PLAYER GETS A SAFETY. OPPONENT GETS TWO (2) POINTS AND RECEIVES THUMPOFF. If no touchdown is scored, player may attempt a field goal on fourth thump only unless a penalty is involved. Player may then try only on last down of play to attempt a field goal. Field goal must be attempted from hash mark closest to ball. If no touchdown is scored, field goal counts three (3) points. If a touchdown is scored, player may elect to try for two points by placing ball flat with one of the three (3) pointed ends of ball at tip of one of the two point markers 58. Player gets one thump to try to get any part of the ball on edge of end zone toward opponent without it falling into net. Preferably a four flags 60 shown in FIG. 4A are placed in holes 62 in the END ZONE. Flags 60 have a circular bottom post **60*a* which is inserted into hole 62, and an upper portion 60*b* which is a solid cylinder. Flags 60** my be omitted if desired.

16. When thumping field goal, the ball must be picked up from a flat position into an upright position with one of the three-pointed ends in the center of the hash mark when thumping field goals. This must be done within a time limit: High School ten (10), College five (5), and Pro three (3) seconds. Count "1001, 1002, 1003," etc. Count fast; counting must be understandable. Refs must not start counting until player says he is ready. Player can touch ball in flat position before standing to attempt field goal.

GAME WINNER

17. High School: 1st player to score 28 points or more

18. College: 1st player to score 21 points or more

19. Pro: 1st player to score 14 points or more

20. Players have a ten minute time limit to score these points. If points are not scored in ten minutes, the game goes into SUDDEN DEATH (OVERTIME.) Referee flips coin again to see which player receives first ball. Player who did not call on first coin toss gets to call second coin toss. FIRST PLAYER TO SCORE, WINS. NOTE: DEGREE OF DIFFICULTY OR SKILL REQUIRED IN GAME PLAY IS DETERMINED BY SIZE OF THUMP BALL 52. THE LARGE SIZE SHOWN IN FIG. 3A IS DESIGNATED "HIGH SCHOOL", THE MEDIUM SIZE SHOWN IN FIG. 3B IS DESIGNATED "COLLEGE", AND THE SMALL SIZE SHOWN IN FIG. 3C IS DESIGNATED "PRO" OR "PROFESSIONAL".

Although the preferred embodiments of the invention have been described in detail above, it should be understood that the invention is in no sense limited thereby, and its scope is to be determined by that of the following claims:

What is claimed is:

1. A finger football game device comprising:

a. a generally rectangular game board having a generally planar playing surface and a simulated football, b. a football field marked on said planar playing surface, said football field including a plurality of parallel yard lines, two parallel sidelines numbered and placed at five unit intervals, two parallel goal lines adjacent to said yard lines, two end zones, and two hash marks located on each of said yard lines, each of said hash marks being equidistant from the closest sideline thereto at an approximate distance from the closest sideline of one-fourth of the total length of said yard line on which said hash mark is located, c. a trough means located adjacent to each of said goal lines for catching said simulated football, said two trough means comprising a rectangular opening having one longer edge located adjacent to one of said goal lines, said trough means having a net means connected to the bottom thereof for catching said simulated football, said trough means having four sides connected perpendicularly to the bottom of said game board around the periphery of said rectangular opening, d. two goal post means movably connected to said planar surface, both of said two goal post means comprising an "H" shaped rigid goal post, and a net connected thereto for preventing Said simulated football from passing therethrough, and e. eight cylinder means connected thereto for receiving and holding said goal post means, two of said cylinder means being located in each of said end zones on the side of said trough opposite said goal line and four of said cylinder means being located on the longer sides of said game board adjacent to said parallel sidelines, whereby said cylinder means on the longer sides of the game board receive the goal post means when not in use.

2. The game device of claim 1 wherein said simulated football is a triangular shaped game piece.

3. A method of playing a simulated football game with two players comprising:

a. providing a generally rectangular game board having a generally planar playing surface and a simulated football; a football field marked on said planar playing surface, said football field including a plurality of parallel yard lines, two parallel sidelines numbered and placed at five unit intervals, two parallel lines adjacent to said yard lines, two end zones, and two hash marks located on each of said yard lines, each of said hash marks being equidistant from the closest sideline thereto at an approximate distance from the closest sideline of one-fourth of the total length of said yard line on which said hash mark is located; a trough means located adjacent to each of said goal lines for catching said simulated football, said two trough means comprising a rectangular opening having one longer edge located adjacent to one of said goal lines, said trough means having a net means connected to the bottom thereof for catching said simulated football, said trough means having four sides connected perpendicularly to the bottom of said game board around the periphery of said rectangular opening; two goal post means movably connected to said planar surface, both of said two goal post means comprising an "H" shaped rigid goal post, and a net connected thereto for preventing said simulated football from passing therethrough; and eight cylinder means connected thereto for receiving and holding said goal post means, two of said cylinder means being located in each of said end zones on the side of said trough opposite said goal line and four of said cylinder means being located on the longer sides of said game board adjacent to said parallel sidelines, b. one player thumping with a finger said simulated football along said game board, c. awarding points when said simulated football is thumped by a finger of a player to a position where a portion of said simulated football is located over said opening, d. awarding possession of said simulated football to the other of said two players when said football is thumped by one of said players into said trough, e. removing said rigid goal posts from said cylinder means on the longer side of the game board and placing said rigid goal posts in each of said two end zones adjacent to said end zone on the side of said trough farthest from said goal line, and f. awarding points when said simulated football is thumped over one of said goal posts by one of said players.

* * * * *